US005421748A

United States Patent [19]

Mouissie

[11] Patent Number: 5,421,748

[45] Date of Patent: Jun. 6, 1995

[54] HIGH-DENSITY, HIGH-VOLTAGE-PROOF, MULTI-CONTACT CONNECTOR ASSEMBLY

[75] Inventor: Bob Mouissie, Ek Berlicum, Netherlands

[73] Assignee: Filtec Filtertechnologie fuer die Elektronikindustrie, Lippstadt, Germany

[21] Appl. No.: 169,519

[22] Filed: Dec. 17, 1993

Related U.S. Application Data

[63] Continuation-in-part of Ser. No. 927,463, Aug. 10, 1992, abandoned.

[51] Int. Cl.[6] ..... H01R 13/41

[52] U.S. Cl. ..... 439/740; 439/733

[58] Field of Search ..... 439/733, 740

[56] References Cited

U.S. PATENT DOCUMENTS

| | | | |
|---|---|---|---|
| 3,031,639 | 4/1962 | Majewski | 439/740 |
| 3,122,407 | 2/1964 | Cowe | 439/740 |
| 3,569,918 | 3/1971 | Arnold | 439/733 |
| 3,897,131 | 7/1975 | Stauffer | 439/733 |
| 4,214,802 | 7/1980 | Otani et al. | 439/281 |
| 4,641,909 | 2/1987 | Steffinger | 439/752 |
| 5,158,479 | 10/1992 | Mouissie | 439/733 |

*Primary Examiner*—Gary F. Paumen

*Attorney, Agent, or Firm*—Herbert L. Lerner; Laurence A. Greenberg

[57] ABSTRACT

The invention relates to a high-density, high-voltage-proof, multi-contact connector assembly. In order to overcome the problem of surface leakage currents or electrical discharges due to high voltage, the structure of terminals of the connector assembly has been changed in such a way as to provide male terminals with insulating ferrules, so that there will no longer be any gap for electric surface currents where two thermoplastic parts of the insulating body of a connector are pressed one part against the other. According to another embodiment, this problem is solved by forming an insulating body of the connector in one piece and inserting the terminals into openings being smaller than the diameter of the terminals, so that the undersized part of the opening is located in the depth of the opening and the creep distances are enlarged. Additionally, the terminals are provided with cutting barbs which, upon a rotation within the opening in the thermoplastic part, cut into the material and securely lock the terminals in place.

5 Claims, 4 Drawing Sheets

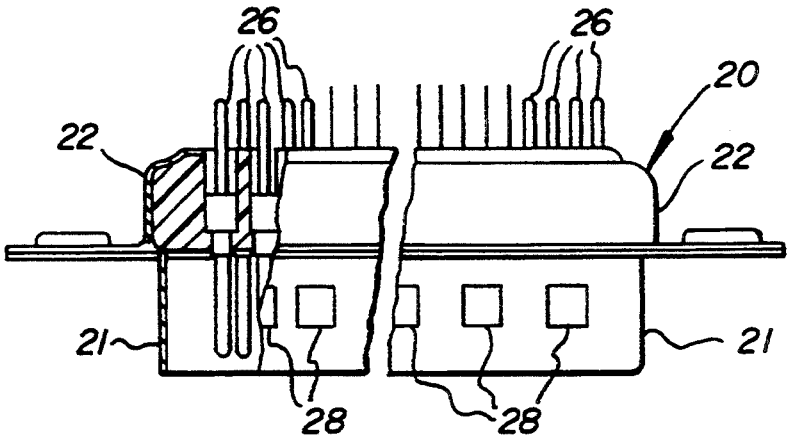
Fig. 5
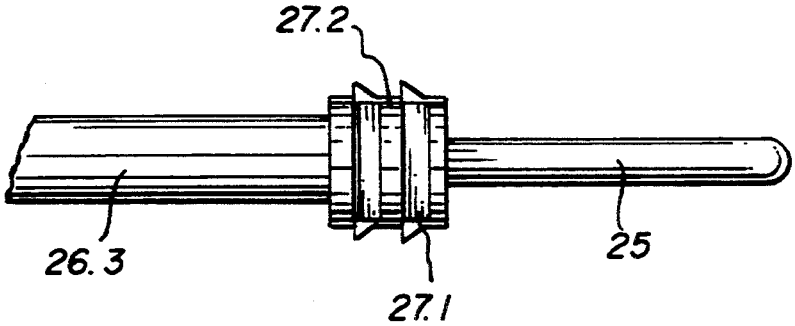
Fig. 6a
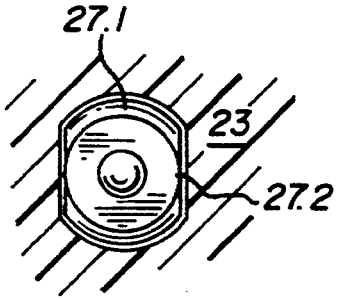
Fig. 6b
Fig. 6c
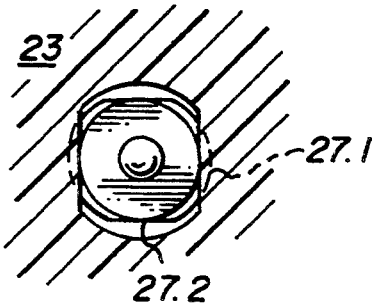

HIGH-DENSITY, HIGH-VOLTAGE-PROOF, MULTI-CONTACT CONNECTOR ASSEMBLY

CROSS-REFERENCE TO RELATED APPLICATION

This application is a continuation-in-part of my application Ser. No. 07/927,463 filed August 10, 1992, now abandoned.

BACKGROUND OF THE INVENTION

1. Field of the Invention

The invention relates to a high-density, high-voltage-proof, multi-contact connector assembly.

2. Description of the Related Art

Multi-contact connectors, such as standard D-Sub connectors and the like, have been used for years as interface/input-output connectors for electronic equipment such as computers, measurement/test equipment, and telecommunication equipment, etc.. More complex electronic equipment requires higher pin count connectors. Therefore, the existing D-Sub standard connectors have been modified in such a way that the number of contacts has been increased and instead of having two rows of contacts, the new structure has three rows. That modification increased the number of contacts from a 9-position connector to a 15-position connector, from a 15-position connector to a 25-position connector, from a 25-position connector to a 44-position connector, or from a 37-position connector to a 64-position connector. On the other hand, the sensitivity against overvoltage-pulses also increased.

The increase in the number of contacts resulted in smaller pattern/grids between the terminals in connection with smaller distances between them and therefore limited the allowable overvoltage-peaks. That disadvantage caused lower limits of operating voltage, in so far as a dielectric withstanding voltage and a current rating, with respect to EOS (Electrical Over Stress), EDS (Electro-Static Discharge) and EMP (Electro-Magnetic Pulse), are concerned.

SUMMARY OF THE INVENTION

Taking into consideration the standard structure of a high-density connector for female and male connectors, the distance between the two thermoplastic parts became so small that a structure withstanding voltages of 2400 to 1200 volts in the standard connector dropped to 1200 to 800 volts in the high-density version. Such an effect is caused mainly by electric surface-discharges. That is due to the insulating body made of thermoplastic inside the shielding shell, which is divided in two parts in order to fix the insulating body in place. The insulating body which bears the terminals of the connector is also divided into two parts. The terminals of the male or female-type are located in the insulating body and are fixed by assembling one part onto the other, so that the terminals are form-lockingly located in corresponding openings. A form-locking connection is one which connects two elements together due to the shape of the elements themselves, as opposed to a force-locking connection, which locks the elements together by force external to the elements. The gap between the two parts of the insulating body causes creep distances for surface leakage currents or electric gas discharges. Sharp peaks or edges on the terminals lower the starting potential of the surface currents, so that the peak-voltage during operation is also lowered.

It is accordingly an object of the invention to provide a high-density, high-voltage-proof, multi-contact connector assembly, which overcomes the hereinafore-mentioned disadvantages of the heretofore-known devices of this general type.

With the foregoing and other objects in view there is provided, in accordance with the invention, a high-density, high-voltage-proof connector assembly, comprising a housing having thermoplastic parts with openings formed therein; male terminals and female terminals each being disposed in a respective one of the openings, the terminals each having connecting elements with means for mechanically retaining the terminals at a sufficient distance to withstand high voltage and suppress surface leakage currents and electrical discharges; the connecting elements of each of the female terminals and the male terminals have solder pin-type, solder cup-type or crimp tail-type connecting ends; insulating ferrules each surrounding a respective one of the male terminals, each of the insulating ferrules having a protrusion; and the openings having recesses around the female terminals, each of the recesses receiving a respective one of the protrusions of the insulating ferrules.

The insulating ferrules have been placed over the terminals so that there will no longer be any gap for electric surface currents where the two plastic parts of the insulating body of the connector are assembled one part against the other.

In accordance with another feature of the invention, the recesses formed around the female terminals have conically-shaped ends and the protrusions of the insulating ferrules have conically-shaped ends fitting into the conically-shaped ends of the recess. This is done in order to minimize the gap between the male-type and the female-type connectors that are joined to each other. The female-type connector with the conical lead-in or recess around each female terminal cooperates with the insulating ferrule having the corresponding conical protrusion around each male terminal, to form a closed shape when the protrusion is inserted in the conical lead-in.

With the objects of the invention in view, there is also provided a high-density, high-voltage-proof connector assembly, comprising a housing having a male-type connector and a female-type connector with front surfaces to be joined together, the connectors each having a thermoplastic part with openings formed therein; male terminals each being disposed in a respective one of the openings in the male-type connector, female terminals each being disposed in a respective one of the openings in the female-type connector, the terminals each having connecting elements with means for mechanically retaining the terminals at a sufficient distance to withstand high voltage and suppress surface leakage currents and electrical discharges; the male terminals having connecting ends with given diameters, each of the openings in the male-type connector having a recessed portion with a diameter being smaller than the given diameter; the female terminals have connecting ends, and the connecting ends of each of the female terminals and the male terminals are solder pin-type or solder cup-type or crimp tail-type connecting ends; and the front surface of the male-type connector having protrusions, and the front surface of the female-type connector having recesses formed therein each receiving a respective one of the protrusions.

It is therefore seen that another way to solve the problem is to form the insulating body of the connector in one piece and to insert the terminals into openings being undersized with respect to the diameter of the terminals, whereby the undersized part of the opening is located in the depth of the opening, so that the creep distances are enlarged. The female-type connector is provided with a conical recess or lead-in around each female terminal and the male-type connector is provided with corresponding cones or conical protrusions around each male terminal to form a closed assembly in the conical lead-ins.

In accordance with another feature of the invention, the male terminals and/or the female terminals have at least partly barbed shoulders.

In accordance with a concomitant feature of the invention, the male terminals and/or the female terminals have means for unlocking the terminals with a ±90° rotation, each of the shoulders of the terminals has barbs and flat portions, the barbs and the flat portions are disposed in opposed pairs, and each of the openings receiving the terminals has the shape of an oblong hole at least in a region receiving one of the shoulders. The barbs on the barbed shoulders of the female terminals have sharp cutting edges which, upon rotation within the oblong opening, cut into the material bounding the opening. When the terminal is rotated further by 90° or the locking rotation of 90° is reversed, the terminals become free.

Other features which are considered as characteristic for the invention are set forth in the appended claims.

Although the invention is illustrated and described herein as embodied in a high-density, high-voltage-proof, multi-contact connector assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
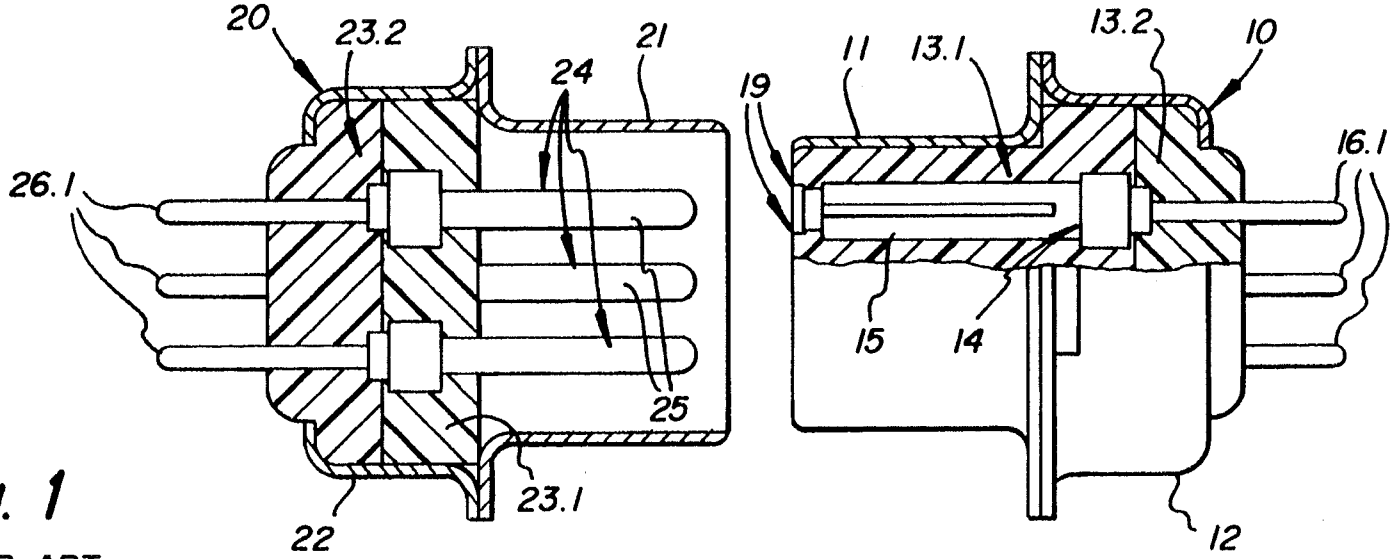
Fig. 1 PRIOR ART
FIG. 1 is a diagrammatic, partly broken-away, sectional view of a high-density connector of the known type with male and female-type connectors, before joining.
Figure 2A:
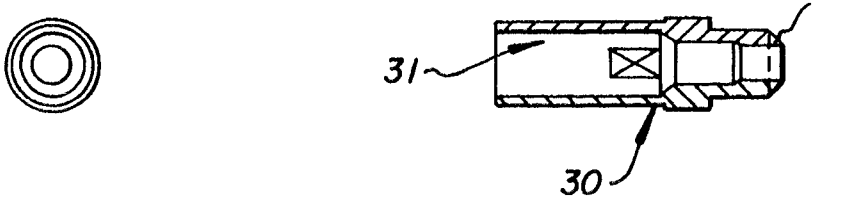
Figure 2B:
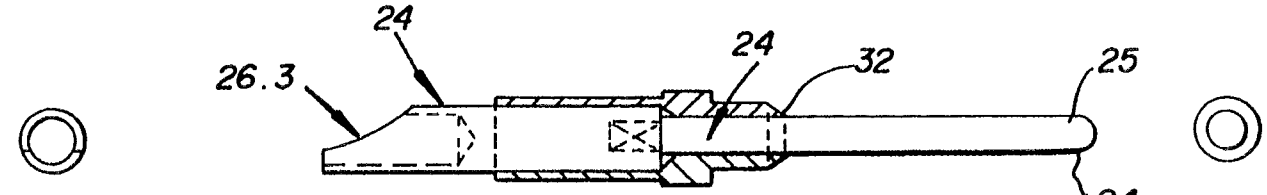
Figure 2C:
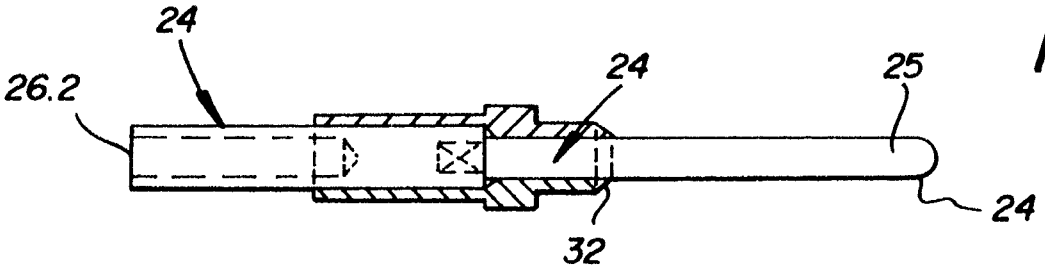
Figure 3:
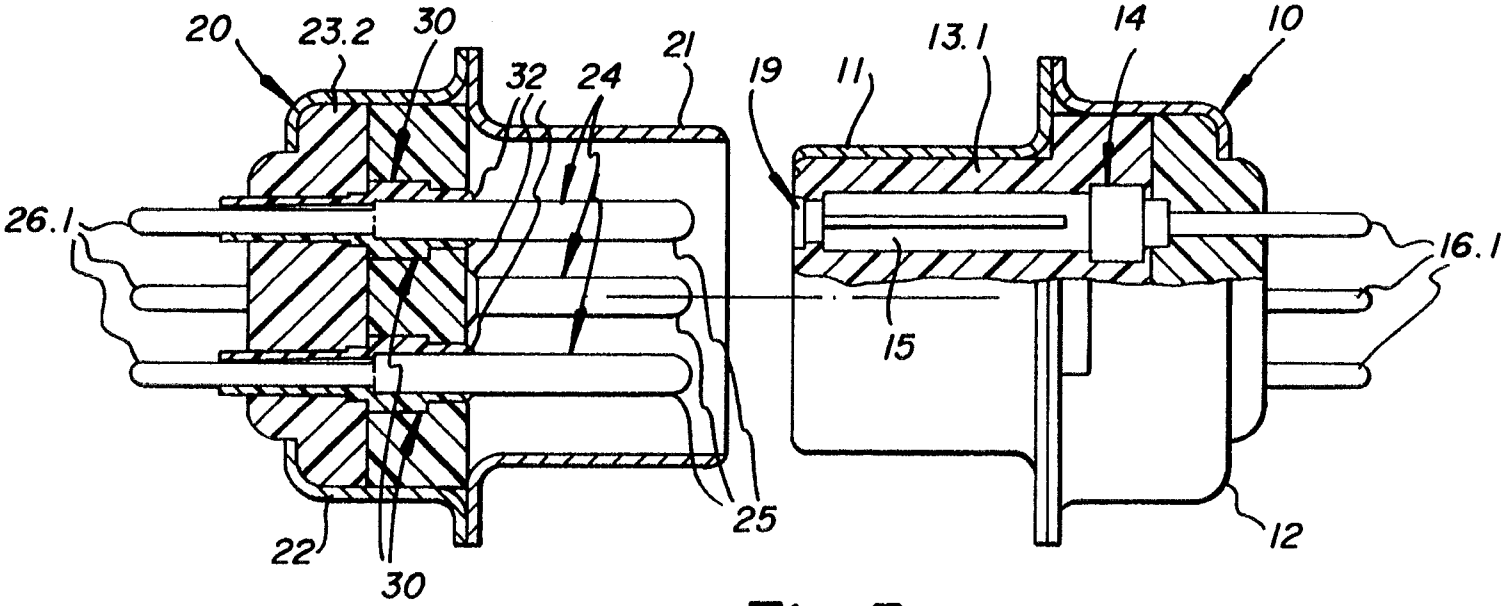
Figure 4:
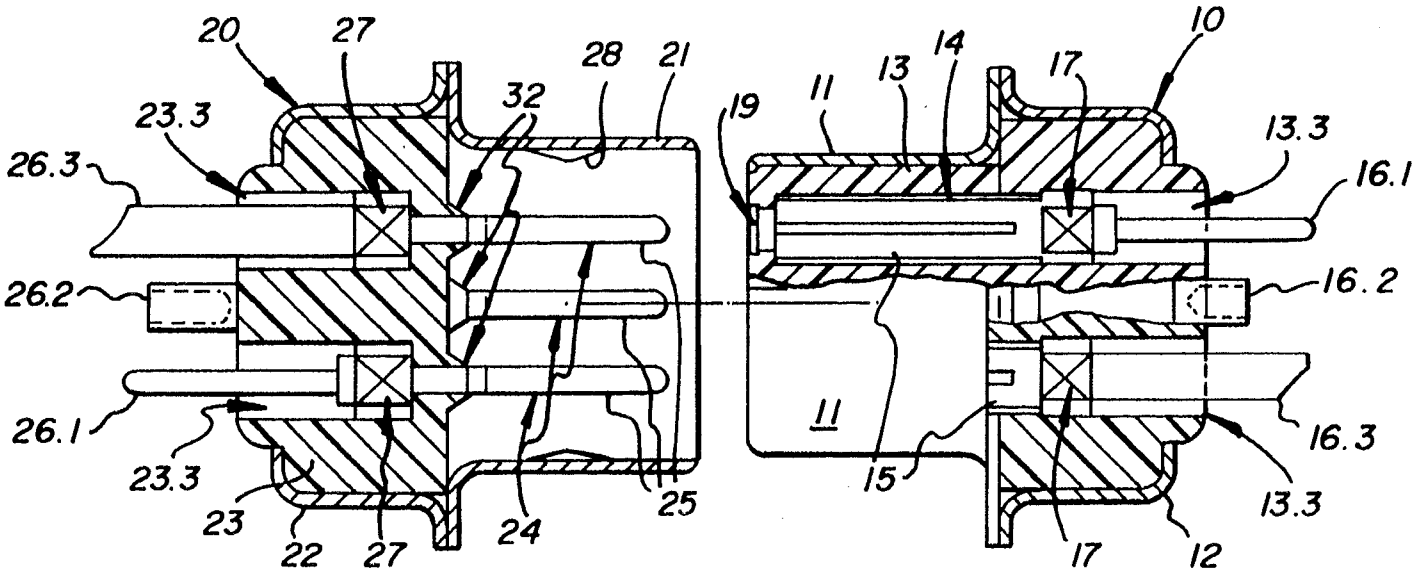
Figure 4A:
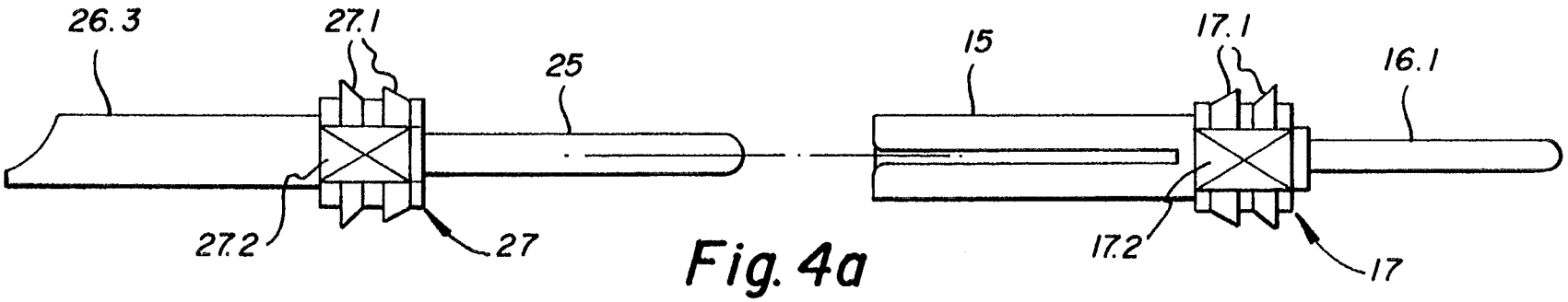

FIGS. *2a*, *2b* and *2c* are sectional views of a terminal for a new-type high-density, high-voltage-proof connector with insulating ferrules, wherein FIG. *2a* shows an insulating ferrule, FIG. *2b* shows a male terminal with an insulating ferrule and a solder cup, and FIG. *2c* shows a male terminal with insulating ferrules and a crimp-tail, that is placed in the same ferrule type 2.1;

FIG. 3 is a view similar to FIG. 1 of a new-type high-density, high-voltage-proof connector with terminals according to FIG. 2 of a male and female-type connector;

FIG. 4 is another view similar to FIGS. 1 and 3 of another type of a three-row, high-density, high-voltage-proof connector with male and female-type terminals in a one-piece housing;

FIG. 4*a* is an enlarged elevational view of a male and a female terminal;

FIG. 5 is a partly broken-away, elevational view of a male-type connector.

FIG. 6*a* is a view similar to FIG. 4*a* of a male-type terminal, but rotated by 90°; and FIGS. 6*b* and 6*c* are front views showing the terminal of FIG. 6*a* inserted in corresponding openings of the thermoplastic part.

DESCRIPTION OF THE PREFERRED EMBODIMENTS

Referring now in detail to the figures of the drawing, in which like numerals identify similar parts throughout, and first, particularly, to FIG. 1 thereof, there is seen a female-type connector 10 which receives a male-type connector 20. The female-type connector 10 has front and rear shells 11, 12 and the male-type connector 20 has front and rear shells 21, 22. The front shell 21 of the male-type connector 20 is introduced into the front shell 11 of the female-type connector 10, and pins 25 of male terminals 24 of the male-type connector 20 are introduced into a socket 15 of female terminals 14 of the female-type connector 10. The front surface of the female-type connector 10 is provided with lead-ins or recesses 19 surrounding each of the female terminals 14. Connecting elements of the female terminals 14 and connecting elements of the male terminals 24 may have respective solder pin-type connecting ends 16.1 and 26.1 shown in FIG. 1, or solder cup-type connecting ends 16.2 and 26.2 or crimp tail-type connecting ends 16.3 or 26.3 shown in FIG. 4. The rear shell 12 of the female-type connector 10 and the rear shell 22 of the male-type connector 20 complete the housings of both of the connectors. Disposed inside the housings are insulating bodies, either inside the female-type connector 10 or the male-type connector 20. The insulating bodies of the female-type connector and the male-type connector are respectively divided into two parts 13.1, 13.2 and 23.1, 23.2, so that the terminals 14 and 24 may be assembled by pressing the two parts of each body against the other when closing the housing formed by the rear and front shells 11 and 12 or 21 and 22, e.g. by point-welding or by riveting, etc..

FIGS. *2a*, *2b* and *2c* show a new structure of the male terminals 24. An insulating ferrule 30 surrounds the male terminal 24 leaving the pin 25 and the connecting end 26.2, 26.3 free for connecting purposes. The insulating ferrules 30 reach through the front and the rear shells 21 and 22 of the male-type connector 20, they enlarge the creep-distance and they cut off surface currents, so that the male-type connector according to the invention provides more safety against such disturbing effects than the prior art one. The insulating ferrule 30 mainly has the shape of a tube 31 receiving the male terminal 24 and is provided with a conical protrusion 32 for fixing the insulating ferrule 30 in the insulating body 23.1 corresponding to the front shell 21. The shape of the conical protrusion 32 of the insulating ferrule furthermore corresponds to the conical shape of the lead-in or recess 19 surrounding each of the female terminals. One of the male terminals 24 has a solder cup-type connecting end 26.2 and the other of the male terminals 24 has a crimp tail-type connecting end 26.3.

The female-type connector 10 and the male-type connector 20 which are shown in FIG. 3 just before joining, are provided with female terminals 14 and with male terminals 24, with the latter being constructed according to FIG. 2. The terminals 14 and 24 are located in the insulating bodies which are both divided into the two parts 13.1, 13.2 and 23.1, 23.2 with gaps between these two parts. Each of the male terminals 24 is surrounded by an insulating ferrule 30, in such a way that the insulating ferrules 30 close the gaps and enlarge the creep-distance, so that surface currents and discharges are suppressed. The conical protrusion 32 at the pin-end of the insulating ferrule 30 protrudes form the front surface of the insulating body 23.1, 23.2 of the male-type connector 20 for leading into the conical lead-in or recesses 19 in the front surface of the insulating body 13.1, 13.2 of the female-type connector 10. Due to the insulating ferrules 30, the gaps between the two parts 23.1 and 13.1 as well as between the two parts 23.2 and 13.2 of the insulating bodies of the female and male-type connectors 10, 20 is closed, so that surface leakage currents or electrical discharges are suppressed.

A more economical embodiment is indicated in FIG. 4, where an insulating body 13 of the female-type connector 10 and an insulating body 23 of the male-type connector 20 are monoblock-like and are each formed as one part of thermoplastic material, instead of the two thermoplastic parts 13.1, 13.2 and 23.1, 23.2 of the other embodiment. The terminals 14, 24 having the sockets 15, 25 are constructed in such a way that by inserting them into openings 13.3, 23.3 a self-locking operation takes place in order to keep the terminals in place and in proper position.

Therefore, as is shown in FIGS. 4*a* and 6*a* each of the respective terminals 14, 24 is provided with a shoulder 17, 27 having barbs 17.1, 27.1 and flat portions 17.2, 27.2 for fixing the terminal 14, 24 in one of the openings 13.3, 23.3 for the terminals in the monoblock-like, one-piece-part of the insulating body 13, 23 by inserting, or in case an unlocking is desired, by means of a ±90 rotation to lock (FIG. 6*c*) or unlock (FIG. 6*b*) the terminal. The barbs 17.1, 27.1 and the flat portions 17.2, 27.2 are disposed in opposed pairs, and each of the openings 13.3, 23.3 receiving the terminals 14, 24 has the shape of an oblong hole at least in a region receiving one of said shoulders. The barbs 17.1 and 27.1 have sharp edges which cut into the material of the thermoplastic part by the locking rotation. The terminal 14, 24 is thus securely locked in place. A counter-rotation of the terminals 14, 24 unlocks the terminals, because the position of the barbs changes from the locked to the unlocked position. The cross-section of the barbed end of the terminals is that of an oblong opening, the wider side of which is formed by the opposed barbs and the narrower sides are formed by the flat portions of the portions. FIG. 4*a* shows the respective male and female terminals 14 and 24 with the sockets 15, 25, the shoulders 17 and 27 provided with the barbs 17.1 and 27.1 as well as the flat portions 17.2 and 27.2 in an illustration in which they are aligned and on an enlarged scale. For the purpose of properly receiving the barbed shoulders, the openings 13.3, 23.3 are provided with an oblong cross-section. The wider diameter of the openings corresponds to the diameter across the barbs 17.1, 27.1 and the smaller diameter corresponds to the distance between the flat portions of the terminals. This kind of structure opens the way to form an insulating body without any gap inside. Therefore, internal surface leakage currents or electrical discharges are also suppressed. The front shell 21 is provided with a clamping crease 28 for securing the seating of the connector as well as a ground-connection.

FIG. 5 shows clamping creases 28 of the male-type connector 20 which are disposed in a row, in connection with securing the ground-connection and the safety of the seating. After being joined into the female-type connector 10, the seating of the male-type connector 20 is secured by these clamping creases 28, which are given a springy construction in any known manner, so that there are forces acting to secure the seating of the joined male-type connector and to ensure a low-resistance ground-connection.

When the terminal is rotated by 90° (from the position shown in FIG. 6*b* to the position shown in FIG. 6*c*), the barbs 27.1 cut into the sidewalls of the oblong hole formed in the thermoplastic part 23.

I claim:

1. A high-density, high-voltage-proof connector assembly, comprising:

a housing having a male-type connector and a female-type connector with front surfaces to be joined together, said connectors each having a thermoplastic part with openings formed therein;

male terminals each being disposed in a respective one of said openings in said male-type connector, female terminals each being disposed in a respective one of said openings in said female-type connector, said terminals each having connecting elements with means for mechanically retaining said terminals at a sufficient distance to withstand high voltage and suppress surface leakage currents and electrical discharges;

said front surface of said male-type connector having protrusions, and said front surface of said female-type connector having recesses formed .therein each receiving a respective one of said protrusions;

at least one of said terminals having means for unlocking the same from the respective thermoplastic part;

said at least one of said terminals having shoulders with barbs and flat portions disposed in opposed pairs, said shoulders with said barbs and said flat portions defining an oblong cross-section; and said openings receiving said terminals having the shape of an oblong hole at least in a region receiving one of said shoulders, the shape and size of the oblong hole substantially corresponding to the oblong cross-section of said at least one terminal, such that when said shoulders are inserted in said openings and rotated by substantially 90°, said barbs out into the material of said thermoplastic part and lock said at least one terminal in place.

2. The high-density connector assembly according to claim 1, wherein said female terminals have connecting ends, and said connecting ends of each of said female terminals and said male terminals are solder pin-type connecting ends.

3. The high-density connector assembly according to claim 1, wherein said female terminals have connecting ends, and said connecting ends of each of said female terminals and said male terminals are solder cup-type connecting ends.

4. The high-density connector assembly according to claim 1, wherein said female terminals have connecting ends, and said connecting ends of each of said female terminals and said male terminals are crimp tail-type connecting ends.

5. The high-density connector assembly according to claim 1, wherein said unlocking means are means for unlocking with a ±90° rotation.

* * * * *